United States Patent [19]

Marsh, II

[11] 4,003,284

[45] Jan. 18, 1977

[54] ELECTRONIC MUSICAL INSTRUMENT

[76] Inventor: David W. Marsh, II, 105 Sheldon St., Providence, R.I. 02906

[22] Filed: Apr. 10, 1975

[21] Appl. No.: 566,693

[52] U.S. Cl. ..... 84/1.18; 84/1.28

[51] Int. Cl.[2] ..... G10H 3/06

[58] Field of Search ..... 179/15 A; 315/8.5, 16; 250/549; 84/1.01, 1.17, 1.18, 1.28, DIG. 19

[56] References Cited

UNITED STATES PATENTS

| | | | |
|---|---|---|---|
| 2,171,936 | 9/1939 | Kucher | 84/1.28 |
| 2,241,027 | 5/1941 | Bumstead | 84/1.18 X |
| 2,528,020 | 10/1950 | Sunstein | 84/1.28 X |
| 2,900,861 | 8/1959 | Davis | 84/1.28 |
| 3,484,530 | 12/1969 | Rupert | 84/1.28 X |

*Primary Examiner*—Ulysses Weldon
*Attorney, Agent, or Firm*—Barlow & Barlow

[57] ABSTRACT

An electronic musical instrument is provided to produce audible tones by the use of at least a pair of electron beam guns having deflecting means, the output of the guns energizing luminous screens with masks in front of the screens of the tubes upon which is graphically depicted an image that represents one or more timbres or mixing control voltages. Electronic means are provided for energizing the cathode ray tubes so that they will scan the masks and light sensitive devices are focused on the images produced by the masks and a variety of means are used to mix the outputs.

8 Claims, 6 Drawing Figures

ELECTRONIC MUSICAL INSTRUMENT

BACKGROUND OF THE INVENTION

Electronic musical instruments and more particularly music synthesizers today can generally produce only one particular note at a time and secondly they can produce only one particular tone quality at a time. Thus unlike a piano which can be played with up to ten notes simultaneously and run through an entire music composition without stopping, the synthetic electronic music devices or synthesizers today can generally play one finger music and whenever one wants to change the quality of the notes the performer must stop and reprogram the music. Generally this is done today by utilizing as part of the system a tape recorder. Thus a solo performer needs a tape recorder to produce musical sounds, and the only manner of producing a number of sounds, are with a number of performers all using synthesizers, much as would be created with a live group or band.

There have been suggestions in the prior art to use cathode ray tube devices with waveform readers as, for example, in Davis U.S. Pat. No. 2,601,265 and Bumstead U.S. Pat. No 2,241,027 where anodes take waveshape forms and in Rupert U.S. Pat. No. 3,484,530 where a waveform film is used on the face of a cathode ray tube. These devices have certain limitations and do not allow for timbre control and particularly control through the use of a second waveform device.

SUMMARY OF THE INVENTION

Sound has six basic qualities, namely pitch, amplitude, timbre, pitch change shape, amplitude change shape and timbre change shape. It is the principal object of the present invention to provide one or more timbres which may be mixed together to produce new timbres and to provide amplitude control at the output of the voltage produced by the cathode ray tube readers. It is another object of the invention to provide means for mixing these timbres with either manual controls or automatically by the output voltage functions which are produced by cathode ray tube card readers changing the card or changing the timbres or control information and this information may also be used to control the pitch and/or amplitude of the output of the electronic music synthesizer.

These and other objects of the invention are accomplished by providing two or more electron guns with deflection means that may be embodied in cathode ray tubes, each cathode ray tube having a power supply, a high frequency saw tooth oscillator, a sweep oscillator, a semi-transparent photographic card and one or more optical readers which convert the varying intensity light into an electrical wave or output voltage function which is sometimes referred to an envelope. The saw tooth oscillator effectively produces a line of light on the tube face while the sweep oscillator repeatedly moves the line of light across the face of the cathode ray tube. The cyclic rate or pitch of the output voltage function is equal to the sweep oscillator frequency.

DESCRIPTION OF THE PREFERRED EMBODIMENTS

Figure 1:
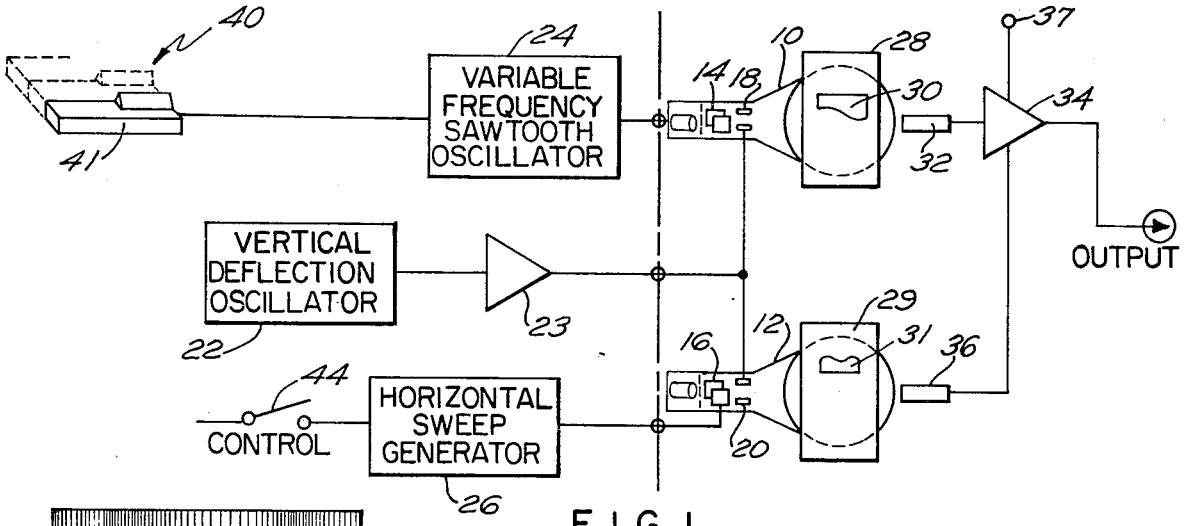
FIG. 1 is a schematic diagram of one embodiment of the invention.

Referring now to the drawings, FIG. 1 shows a pair of cathode ray tubes 10 and 12 both of which will be provided with the usual electron gun and accelerators and the associated power supply that is well known in the art. Deflecting plates 14 and 16 are provided for deflecting the beam horizontally while deflecting plates 18 and 20 will deflect the beam vertically. The vertical deflection is provided by a saw-tooth oscillator 22 having an amplifier 23 which feeds both sets of deflecting plates 18 and 20. Effectively this circuitry will produce a vertical line of light on the tube face. In order to move the line of light across a tube face, it is necessary that a horizontal sweep be provided and to this end a variable frequency saw tooth oscillator 24 is connected to the horizontal plates 14 and this oscillator output will move the line of light produced by the vertical deflection across the face of the cathode ray tube. Similary in connection with tube 12 the horizontal plates 16 are connected to a horizontal sweep generator 26 which will move the line across the tube in the same fashion.

Figure 4:
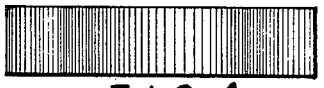
FIG. 4 is a plan view of an alternate form of card.

In front of each tube is an image mask in the form preferably of a photographic card 28, 29 and on these cards is an image of a waveform, depicted on card 28 as a translucent image area 30 surrounded by opaqueness. Alternately the card may take the form shown in FIG. 4 in which the swept or image area 30' is of varying density across the horizontal sweep. As the line of light moves across the tube face, it will shine through the image area 30 of the card and the amount of light coming through the card will vary cyclically at a rate equal to the frequency of the oscillator 24. In a similar fashion in front of tube 12 is a second image area 31 which operates in the same fashion. The filtered output of the cathode ray tube 10 is sensed by a light sensitive device such as a photosensitive diode 32 whose output is fed to an amplifier 34. Similarly a light sensitive device 36 views the filtered output of cathode ray tube 12 and the output of device 36 is also connected to the amplifier 34 to vary its output. Amplifier 34 is preferably a voltage controlled amplifier and if desired even further control may be applied at terminal 37 which can be thought of as an input point for a plurality of resistances or control voltages which would be called stops, as one knows them in organ circuitry, and in effect will increase or decrease the gain of amplifier 34.

In order to actuate one channel, which is all that is shown in FIG. 1, a keyboard generally designated 40 may be provided and one of these keys 41 will be in the form of a switch which will connect a resistor or other control means to the horizontal sweep oscillator 24. Each separate key 41 will therefore effectively cause the oscillator 24 to sweep at a different frequency and change the pitch in output 34. In a similar fashion a control which is shown in the form of a switch 44 will actuate the horizontal sweep oscillator 26 for the cathode ray tube 12 which oscillator will operate in the sub-audio range for example below 15 Hz. Control 44 may be mechanically or electrically connected to key 41 and operate simultaneously therewith.

It will be seen that by the operation of key 41, pitch is selected and the sweep oscillator is triggered which will produce an output function in the form of an electrical wave corresponding to the output as read on the light sensitive means at 32. When the control 44 is triggered, this will modify the amplifier 34 output by effectively controlling the gain thereof and produce at the output terminal a varying amplitude of a single timbre. Sounds can therefore be built up in a variety of fashions by combining a plurality of cathode ray tubes 10, 12 and their associated output circuitry all combined in a single output to obtain a composite timbre, it being understood the images would vary to provide a useful output.

Figure 6:
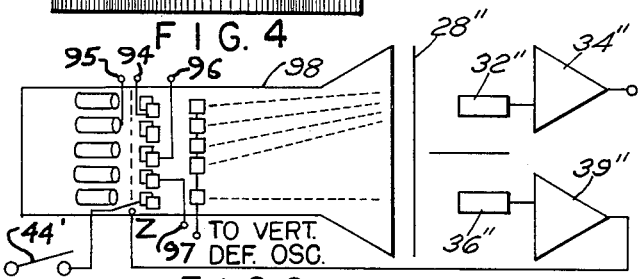
FIG. 6 is a diagrammatic view of a type of tube used for chord production.
Figure 2:
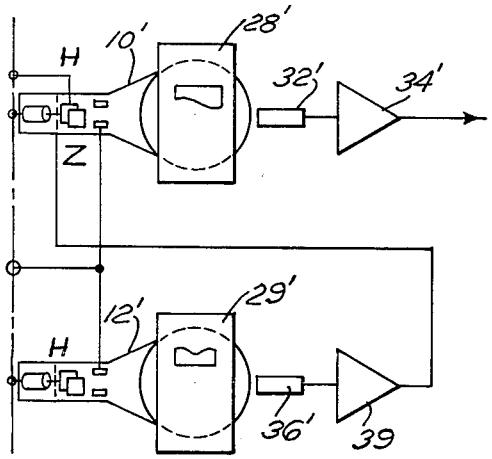
FIG. 2 is a schematic diagram of a modified form of the invention.

Referring to FIG. 2 a modified version for a single channel has been illustrated and here the main difference lies in the fact that the timbres are mixed optically instead of electronically. In this case the light sensitive device 36' is provided with an amplifier Z 39 which feeds the amplitude axis of the cathode ray tube 10' in the same manner as described in FIG. 6 of U.S. Pat. No. 2,601,265. The effect of this is to vary the amount of light behind each card image area and the bands of light change their intensities as the light sensitive device 32 views the waveform so that timbre control is provided. It will be apparent that the timbre variation is not limited to one waveform on tube 12'. Multiple waveforms may be used and optically mixed to provide complex timbre.

Figure 3:
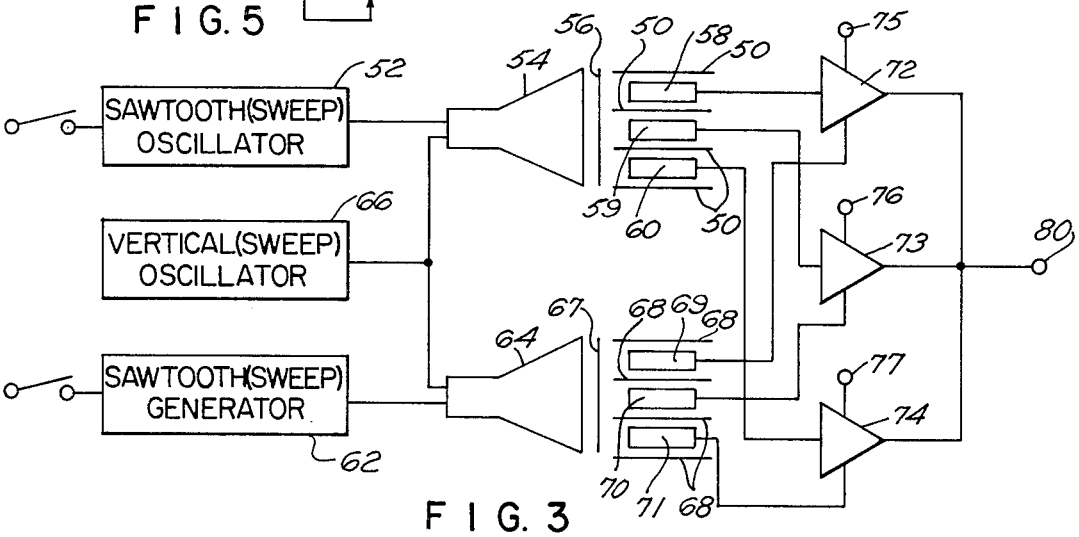
FIG. 3 is a schematic diagram of a still further form of the invention.

It will be apparent that one cathode ray tube may produce a plurality of channel outputs depending only on the size of the tube. Here the tube is broken up into a number of channel areas by the use of opaque barriers which are depicted in FIG. 3 by the lines 50. For simplicity sake three channels have been shown, but of course, it should be understood that this is not limiting but merely illustrative. Accordingly, in FIG. 3 we have shown a three-channel synthesizer which has a saw tooth sweep oscillator 52 that feeds the horizontal plates of cathode ray tube 54 having a mask 56 with three waveforms thereon, each of which are defined between the opaque barriers 50. For each channel a light sensitive device as, for example, the photosensitive diode 58, 59 and 60 is provided. A second horizontal sweep generator 62 is connected to the horizontal plates of a second cathode ray tube 64 and the vertical plates of both tubes 54 and 64 are fed by a vertical sweep oscillator 66. A card 67 is provided for the tube 64 and opaque barriers 68 divide the three images into three channels which are sensed by light sensitive means 69, 70 and 71. Three voltage controlled amplifiers 72, 73 and 74 are provided. It will be seen by referring to the diagram that light sensitive means 58 and 69 feed amplifier 72, light sensitive means 59 and 70 feed amplifier 73 and light sensitive means 60 and 71 feed amplifier 74. Additional control means are applied to terminals 75, 76 and 77 respectively modify further the outputs of the amplifiers 72, 73, 74 respectively, all of which are connected together to a common output terminal 80.

Sounds can therefore be built utilizing fundamentals and harmonics and if a card with a series of areas 30, one with a sine wave and the others with integral numbers of sine waves are used as fundamentals and harmonics they can be synthesized, individually controlled and mixed to produce a whole range of timbres. It should be understood that the waveforms on the cards are not limited to sine waves, but may be complex wave forms or sine waves or complex wave forms that ae not integral multiples of each other, for example, $f_1$ and $(3/2)f_1$, which would be displayed in the same length space as 30.

Figure 5:
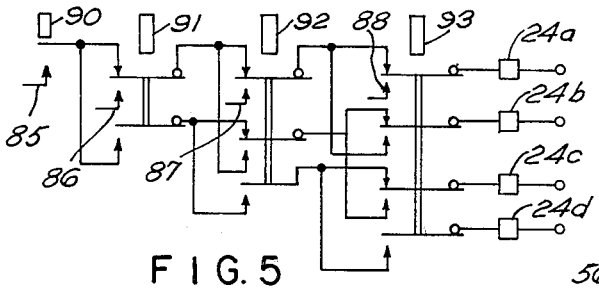
FIG. 5 is a schematic of a chord switching device for use with the invention.

Referring to FIG. 5, there is illustrated one method of producing chords. To achieve pitch the frequencies of saw tooth oscillators 24*a*, 24*b*, 24*c* and 24*d* are varied by their connection to the various tuning means 85, 86, 87 and 88 by the switching matrix. For example, the frequency determining circuits of oscillators 24 may be voltage sensitive so that the tuning means may represent a discrete voltage. The keyboard and switching matrix act to select and arrange the various connections, it being understood that the oscillators will operate only when connected to a tuning device, and that all, none or some may operate at any one time. To this end, one or more buttons 90, 91, 92, 93 may be depressed. Connections are made to the *x* axis inputs 94, 95, 96 and 97 of the tube 98 of FIG. 6. Each oscillator 24 will drive a separate electron gun in cathode ray tube 98. This will effectively produce one, two, three or four lines of light (as diagrammed by dotted lines) on the cathode ray tube 98 face, each moving at different rates. The cumulative light output filtered through card 28'' causes an electrical wave corresponding to a chord sound to be produced at light sensitive device 32''. The fifth gun operates as does cathode ray tube 12' in FIG. 2 and effect the Z (amplifier) axis of all four electron guns in cathode ray tube 98. All four electron beams in cathode ray tube 98 are identically swept in the Y (vertical) axis by an oscillator such as 22 as seen in FIG. 1.

While the invention has been described with particular reference to only two cathode ray tubes, it should be understood that plurality of cathode ray tubes may be utilized in the same fashion and in building block fashion, for example, to produce pluralities of sounds each keyboard or control circuit or stop as the case might be affording additional control all in the manner of the basic instrumentation system that is shown herein. The cathode ray tubes may indeed produce more than one beam, or effectively producing a plurality by a chopped display technique. For example, the four guns diagrammed in FIG. 6 may be replaced by one gun and the technique as shown by U.S. Pat. No. 3,599,034 used to make a compact device with only two electron guns.

I claim:

1. An apparatus for producing audible tones comprising a pair of electron beam guns having vertical and horizontal deflecting means, the output of the guns energizing a luminous screen means in the deflection path of each gun, a mask having thereon means for graphically depicting an image of a waveform representing a tone, located on the face of said luminous screen means, a mask being in the deflection path of each gun, means associated with each of the guns to vertically scan the luminous screen means, separate means associated with each gun to horizontally scan the face of the luminous screen means, light sensitive devices one each focused on the image generated by each of said masks, each light sensitive device converting the optical image representing a tone into an electrical wave, one light sensitive device having a constant output signal representing a tone, said one device modifying the output of the other devices to produce a particular timbre by varying amplitude of the other tones.

2. An apparatus for producing audible tones as in claim 1 wherein the modifying means includes a voltage controlled amplifier, the outputs of said light sensitive devices coupled to said amplifier.

3. An apparatus for producing audible tones as in claim 2 wherein a control voltage is provided, the amplifiers being modified by said control voltage.

4. An apparatus for producing audible tones as in claim 1 wherein the modifying means coupling comprises the output of a light sensitive device associated with a first gun to the Z axis amplitude input of a second gun.

5. An apparatus for producing audible tones as in claim 1 wherein the masks depict a plurality of images and a plurality of light sensitive devices are provided one for each image.

6. An apparatus for producing audible tones as in claim 1 wherein the modifying means includes an amplifier for each light sensitive device of a first gun and the light sensitive device associated with the second gun modifies the output of said amplifier.

7. An apparatus for producing audible tones as in claim 6 wherein a control voltage is provided, the amplifiers being modified by said control voltage.

8. A system for producing audible signals comprising a cathode ray tube generating an electron beam in said tube, horizontal deflection generator means, a vertical deflection generator, at least two mask means representing a waveform of a tone scanned by the beam, said horizontal generator means scanning all waveforms, means detecting the one waveform and converting it to a first electrical signal, said signal modifying the scans of the other mask waveforms by varying the amplitude of the tones represented by the waveforms to produce particular timbres.

* * * * *